US005740816A

United States Patent [19]

Ghazarian et al.

[11] Patent Number: 5,740,816

[45] Date of Patent: Apr. 21, 1998

[54] SMOKING ACCESSORY

[76] Inventors: Raffi Ghazarian, 42 Helen St., Waltham, Mass. 02154; VahéGhazarian, 4 Tory row, Woburn, Mass. 01801

[21] Appl. No.: 781,726

[22] Filed: Jan. 10, 1997

Related U.S. Application Data

[63] Continuation-in-part of Ser. No. 60,520, Sep. 30, 1996.

[51] Int. Cl.[6] ..... A24F 13/24

[52] U.S. Cl. ..... 131/248; 131/250

[58] Field of Search ..... 131/255, 248, 131/250; 30/111, 113, 109; 7/158

[56] References Cited

U.S. PATENT DOCUMENTS 864,703 8/1907 Sibley ..... 131/248

5,535,763 7/1996 Conte ..... 131/255

*Primary Examiner*—Vincent Millin

*Assistant Examiner*—Charles W. Anderson

*Attorney, Agent, or Firm*—Scott B. Garrison

[57] ABSTRACT

A smoking accessory which functions as a cigar hole punch. The implement contains a hidden and detachable cigar hole punch and puncturing awl. The outward or exterior element of the device serves as a storage compartment for housing the puncturing awl and cigar hole punch when they are not in use. The implement itself should be manufactured of a material which enables a user to display the implement as an item of jewelry. Such an implement serves the dual purpose of denoting status for the user as well as providing the user with a useful device for cutting or otherwise opening the sealed end of a cigar.

14 Claims, 1 Drawing Sheet

SMOKING ACCESSORY

CROSS REFERENCE TO RELATED APPLICATIONS

This application claims the benefit in the form of a continuation-in-part under 37 CFR 1.53(b)(1) of currently pending parent application Ser. No. 29/060,520 filed Sep. 30, 1996, still pending by the same inventors.

BACKGROUND

In the past few years there has been a resurgence in the consumption of high quality consumable luxuries; such as coffees, teas, beers, wines, liquors and tobacco. This invention targets those individuals who consume high end tobacco products; specifically cigars. A typical high end or quality cigar is handrolled and often sealed at the end which the smoker places in his or her mouth. In order to smoke the cigar, the sealed end must somehow be broken. The occasional smoker will often have the tobacconist who sold the cigar cut the sealed end off at the time of purchase. This is both undesirable and impracticable if the smoker seeks to have a great many cigars "unsealed" at one time; such as if the smoker purchased a box of cigars. To resolve this, many cigar smokers purchase cutters which work on a guillotine principle to cut the sealed end of the cigar. Other cigar smokers cut the cigar with a knife, poke a hole in the end with a pencil, or simply bite the end off. However, if these methods are not done carefully, the smoker risks tearing the cigar thereby damaging it and potentially rendering it unsmokable.

What is needed is a device which serves to open or otherwise penetrate the sealed end of a cigar. Although guillotine type devices do exist, an alternative to this type of device is desired which also has the capability to appeal to the vanity of luxury cigar smokers. Such a device would be capable of breaking or cutting the sealed end as well as be appealing to the eye and reflect the status of the owner.

SUMMARY

Accordingly, the Applicants' have created such a device, which is both novel and non-obvious. Applicants' invention is in the form of an item of jewelry. This piece of jewelry when opened or disassembled, reveals an otherwise hidden cigar hole punch and a puncturing awl. A smoker would carry or wear the item of jewelry on his or her person and when the person wished to smoke a cigar, the smoker would disassemble the jewelry item to reveal the cigar hole punch, the puncturing awl or both. One of these two implements would be used to punch or cut a hole into the sealed end of the cigar. Both implements are desirable and as such have been provided so as to give the smoker a choice whether he or she punches a large or small hole into the cigar end. Additionally, the awl serves a secondary purpose which is to clean out any tobacco which may catch or otherwise wedge into the hole punch implement itself. Configuring these two implements as hidden components placed within an item of jewelry elevates the device into a luxury consumer good. Other such luxury consumer goods coming to mind in the form of jewelry implements are butane lighters and some highly decorative tobacco pipes. The present invention adds to these luxury smoking accessories by catering to the needs of cigar smokers. Furthermore, with the addition of women to the ranks of cigar smoking, a jewelry implement which can be carried in a purse or even displayed is desirable.

It is therefore the object of the present invention to provide a cigar hole punch which will allow cigar smokers not to depend upon tobacconists to punch a hole in the cigar.

It is another object of the present invention to provide a piece of jewelry that disguises its function as a cigar hole punch.

It is also the object of the present invention to provide a jewelry piece that functions as a cigar hole punch that is of such weight and size that it can be easily carried by an individual on his or her person.

It is also the object of the present invention to provide a cigar hole punch that can be easily cleaned and maintained.

A further object of the present invention is to provide a cigar hole punch which appeals to the vanity and is therefore marketable as a jewelry item.

It is also the object of the present invention to provide the cigar smoker with at least two methods of placing a hole in the non-burning end of the cigar.

Still further objects of the present invention will become apparent from a consideration of the drawings and the ensuing detailed description.

BRIEF DESCRIPTION OF THE DRAWINGS

The novel features considered characteristic of the invention are set forth in the appended claims. The invention itself, however, both as to its construction and its method of operation, together with additional objects and advantages thereof, will best be understood from the following description of the specific embodiments when read and understood in connection with the accompanying drawing.

DETAILED DESCRIPTION

Figure 1:
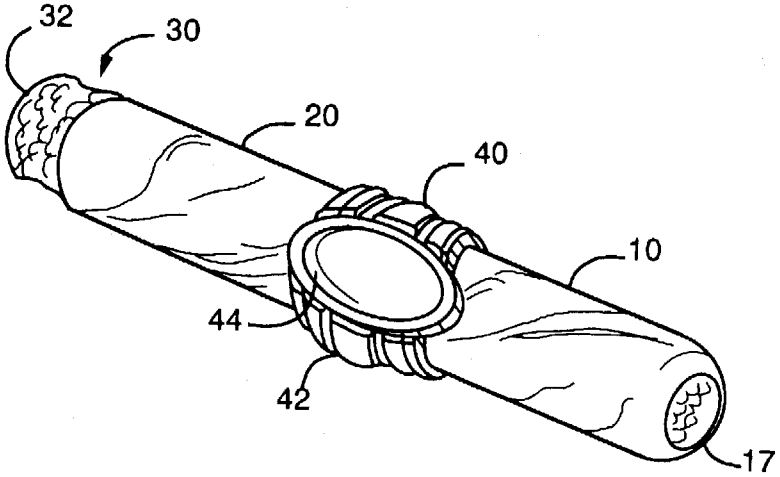
FIG. 1 is a three dimensional perspective view of one preferred embodiment of the present invention as it is normally carried by a smoker.
Figure 2:
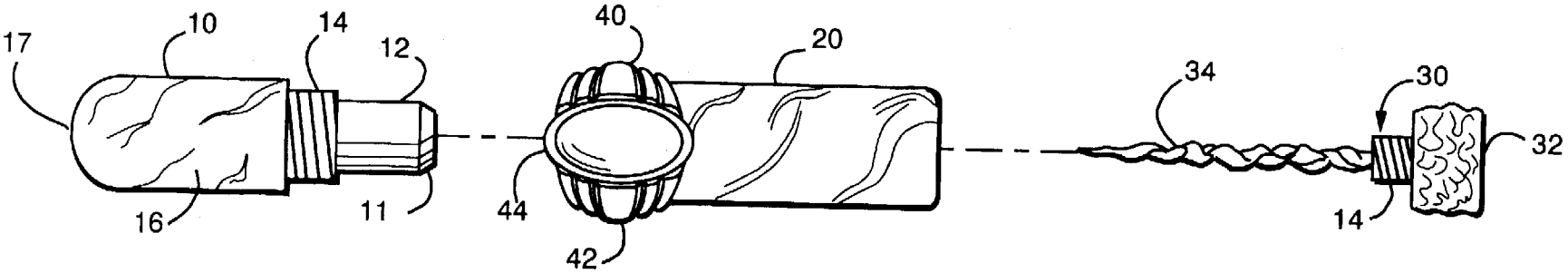
FIG. 2 is a front elevation of the FIG. 1 device as it appears when disassembled.

With reference to FIGS. 1 and 2, a preferred embodiment of the present invention is disclosed. This preferred embodiment would outwardly resemble a cigar, a configuration that would allude to its hidden function as a cigar smoking accessory. The present invention comprises a punch portion 10; a puncturing awl 30; a storage compartment or chamber 20 for housing either or both the awl 30 and the hole punch 10; and an attachment means 14 for attaching the awl 30 and the hole punch 10 to the storage compartment 20. The preferred embodiment of the present invention also includes a raised relief surface 40 for decoration. This raised relief surface which simulates a cigar band and label is, however, not essential to the present invention.

The punch portion 10 is illustrated in FIG. 1, and includes a cutting element 12 at one end of punch portion 10. The preferred embodiment of cutting element 12 would be a cylindrically shaped material sufficiently hard to enable it to puncture a cigar tip when pressed and twisted into a cigar tip. Preferably, the cutting element 12 should be made of metal with a sharpened edge. The cutting element 12 should have a radius that will allow it to puncture a hole in a cigar tip. In order to allow the cutting element 12 to slide easily into a cigar tip, the sharpened edge could be a bevel 11. The cutting element 12 is mounted to or partially encased within a top portion 16 of punch portion 10. Top portion 16 has an open end and a closed end 17. It is at the open end that the cutting element 12 is mounted, if the cutting element 12 is encased within top portion 16, top portion 16 should have an aperture wide enough so that the cutting element 12 fits tightly into it. A portion of the cutting element 12 long enough to puncture a hole in a cigar tip should be left protruding or otherwise non-encased by the top portion 16. The top portion 16 of punch portion 10 can be made from a variety of materials but, preferably, it is made of a precious or semi-precious metal or of some other material having precious or semi-precious metal plating. However, other non-precious materials are also contemplated. Some such materials being more common metals, wood, plastics, etc.

The storage compartment 20 for housing either or both the puncturing awl 30 and the hole punch 10 is illustrated in FIG. 2; it should be of sufficient length and width so that it can contain the puncturing awl's prong 34 and the non-encased portion of the cutting element 12, when these items are not in use.

As with the top portion 16 of punch portion 10, the storage compartment can be made of a variety of materials. Preferably, it is made of similar quality materials as the top portion 16. The puncturing awl 30 is illustrated in FIG. 2. It comprises a prong 34 and an attachment base 32. The attachment base 32 should be made from a material that will support the prong 34 and allow the prong to be either pushed into a cigar tip or used to clean the detachable hole punch 10. The prong 34 should be made of a hard, rigid material. Different embodiments of the prong 34 can be either a straight linear or corkscrew structure. The preferred embodiment uses the corkscrew structure.

Both the puncturing awl 30 and the punch portion 10 are fastened to the storage compartment 20 by an attachment means 14 which can be any method that allows both to be securely attached and easily detached from the storage compartment 20. The preferred embodiment of attachment means 14 is by threading the puncturing awl 30 and the punch portion 10 to storage compartment 20. However other means such as a tabular tongue and receiving groove mechanism would also be satisfactory. Once the device is disassembled, the hole punch 10 or puncturing awl 30 is ready for use. The present invention can also include a transmedial raised relief surface 40 as illustrated in FIGS. 1 and 2. Said raised relief surface 40 should be of sufficient dimension to enable the cigar smoker to more easily grasp the device enabling easier disassembly of the invention due to the greater surface area which can be held. In one preferred embodiment, the raised relief surface comprises a radial attachment band 42 and a display surface 44 which has the appearance of a cigar band typically made of paper found on most cigars. The display surface 44 should be of a size sufficient for engraving with the cigar smokers monogram, a cigar manufacturer's logo, or some other suitable indicia. The radial attachment band 42 serves to hide the joint between the tubular storage compartment 20 and the punch portion 10 because it overlaps the interface between the two. In a preferred embodiment, the radial attachment 42 and the display surface 44 are made of a different color precious or semi-precious metal.

The overall appearance of the assembled device would resemble a lit or burning cigar. A user could display the device by any suitable means. Some means envisioned would be to configure the device as a stick pin, display it in a suitable display case like a quality pen and pencil set, or simply carry it around in the pocket or purse and display it only during use. The inventors are aware that numerous configurations are available which would provide the desired results. While the invention has been described and illustrated with reference to a specific embodiment thereof it is understood that other embodiments may be resorted to without departing from the invention. Therefore, the form of the invention set out above should be considered illustrative and not as limiting the scope of the following claims.

What is claimed is:

1. A smoking accessory comprising:

a tubular storage compartment having two opposing open ends wherein a first open end has a first portion of a first attachment means and a second open end has a first portion of a second attachment means;

a punch portion, wherein said punch portion further comprises a top portion having a cylindrical cutting element affixed to an end of said top portion, and a second, portion of a first attachment means disposed thereon for attaching said punch portion to said tubular storage compartment by engaging said first portion of said first attachment means with said second portion of said first attachment means; and a puncturing awl; wherein said puncturing awl further comprises a base, a prong, and a second portion of a second attachment means disposed thereon for attaching said puncturing awl to said tubular storage compartment by engaging said first portion of said second attachment means with said second portion of said second attachment means.

2. A device in accordance with claim 1 wherein said device when assembled is an item of jewelry.

3. A device in accordance with claim 2 wherein said jewelry is in the shape and configuration of a cigar.

4. A device in accordance with claim 1 wherein said tubular storage compartment, at said first open end further includes a band circumferentially surrounding and further being longitudinally offset from said first open end so as to at least partially overlap said first open end.

5. A device in accordance with claim 4 wherein said overlapping of said band with respect to said first open end results in said band partially straddling at least a portion of each of said tubular storage compartment and said top portion thereby hiding an interface resulting from said tubular storage compartment and said top portion being attached one to the other by said first attachment means.

6. A device in accordance with claim 5 wherein at least a portion of said band comprises a display area.

7. A device in accordance with claim 6 wherein said device when assembled is an item of jewelry.

8. A device in accordance with claim 7 wherein said jewelry is in the shape and configuration of a cigar.

9. A device in accordance with claim 8 wherein said display area is capable of being marked with identifying indicia.

10. A device in accordance with claim 9 wherein said first portion and said second portion of each of said first and second attachment means are threaded.

11. A smoking implement comprising a tubular containment structure having a first and a second open end, each of said ends adapted to internally receive and encase a cylindrical cutting element and a prong at the same time; wherein said cylindrical cutting element protrudes longitudinally from a cylindrical top portion having an attachment means for attaching said top portion to said first open end of said tubular containment structure; and wherein said prong is attached at one end to a base having an attachment means for attaching said base to said second open end of said tubular containment structure; and said prong concentrically resides within said cylindrical cutting element which further resides concentrically within said tubular containment structure.

12. A smoking implement in accordance with claim 11 wherein said cylindrical cutting element forms a cigar hole punch and said prong forms a puncturing awl.

13. A smoking implement in accordance with claim 12 wherein said puncturing awl is capable of removing from said cigar hole punch tobacco which may become wedged within said cigar hole punch.

14. A smoking implement in accordance with claim 13 wherein each of said attachment means is a threaded connection.

* * * * *